US006890240B2

(12) United States Patent
Chen

(10) Patent No.: US 6,890,240 B2
(45) Date of Patent: May 10, 2005

(54) TOY

(75) Inventor: Sheng-Hsi Chen, No. 26, Lane 227, Nung-an St., Jungshan Chiu, Taipei (TW)

(73) Assignees: Sheng-Hsi Chen, Taipei (TW); Chu-Yuan Liao, Taipei (TW)

( * ) Notice: Subject to any disclaimer, the term of this patent is extended or adjusted under 35 U.S.C. 154(b) by 0 days.

(21) Appl. No.: 10/615,184

(22) Filed: Jul. 9, 2003

(65) Prior Publication Data

US 2005/0009442 A1 Jan. 13, 2005

(51) Int. Cl.[7] ..... A63H 17/26
(52) U.S. Cl. ..... 446/469; 446/445; 446/431
(58) Field of Search ..... 446/465, 445, 446/466, 441, 469

(56) References Cited

U.S. PATENT DOCUMENTS 3,810,515 A * 5/1974 Ingro ..... 180/54.2
3,942,285 A * 3/1976 Dehner ..... 446/470
4,764,148 A * 8/1988 Wong ..... 446/431
5,746,641 A * 5/1998 Wong ..... 446/431
5,916,008 A * 6/1999 Wong ..... 446/445

FOREIGN PATENT DOCUMENTS

GB 2196544 * 5/1988

* cited by examiner

*Primary Examiner*—Derris H. Banks
*Assistant Examiner*—J Williams
(74) *Attorney, Agent, or Firm*—Rosenberg, Klein & Lee

(57) ABSTRACT

A toy includes a body of a shape of any animal, automobile, etc. and a roller combined with the body and a shaft. The roller is made of a mixture of TPR (thermal plastic rubber) and white oil so as to give the roller some viscosity, having a plurality of lengthwise convex protrusions formed on its outer circumference, The shaft extends and fixed firmly in a center shaft hole formed in the roller, having two ends supported by two plates fixed on an inner wall of the body to let the roller roll together with the shaft. Then the toy can roll down on a slope or a vertical wall surface with slow speed caused by the roller's viscosity and the convex protrusions.

1 Claim, 3 Drawing Sheets

TOY

BACKGROUND OF THE INVENTION

1. Field of the Invention

This invention relates to a toy, particularly to one having a roller with a proper viscosity so as to roll slowly down on a slope or even a vertical wall surface, without running very fast or falling off.

2. Description of Prior Art

Toys are indispensable for children, such as toy automobiles, dolls, building blocks, jigsaw puzzles, etc. for entertainment, education, etc, too many to enumerate. Those having wheels or rollers are mostly welcomed by them, and can be ridden on if large enough, and some can be controlled remotely. A simple toy vehicle is played on the ground or on a table, and some sophisticated ones run on a track by means of motors or springs, Generally speaking, movable toy vehicles are most favored by children, Some toy vehicles are motivated by power, running on a flat or sloped road, and those running without power may be placed on a slow slope or a flat surface, limited in a proper place for playing.

SUMMARY OF THE INVENTION

This invention has been devised to offer a toy, which mainly has a roller with a proper viscosity to let its outer surface to adhere on a surface with proper adhesiveness and a substantial length, combined with a C-shaped plate by means of a shaft supported in a shaft hole of the C-shaped plate, or a U-shaped rod shaft having one bent end extending in a shaft hole of the roller and the other bent end supported by a plate. Then the support plate is fixed under a toy, and then the toy with the roller can roll and move on a steep slope or even a vertical wall surface, gradually and slowly rolling downward without falling off.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
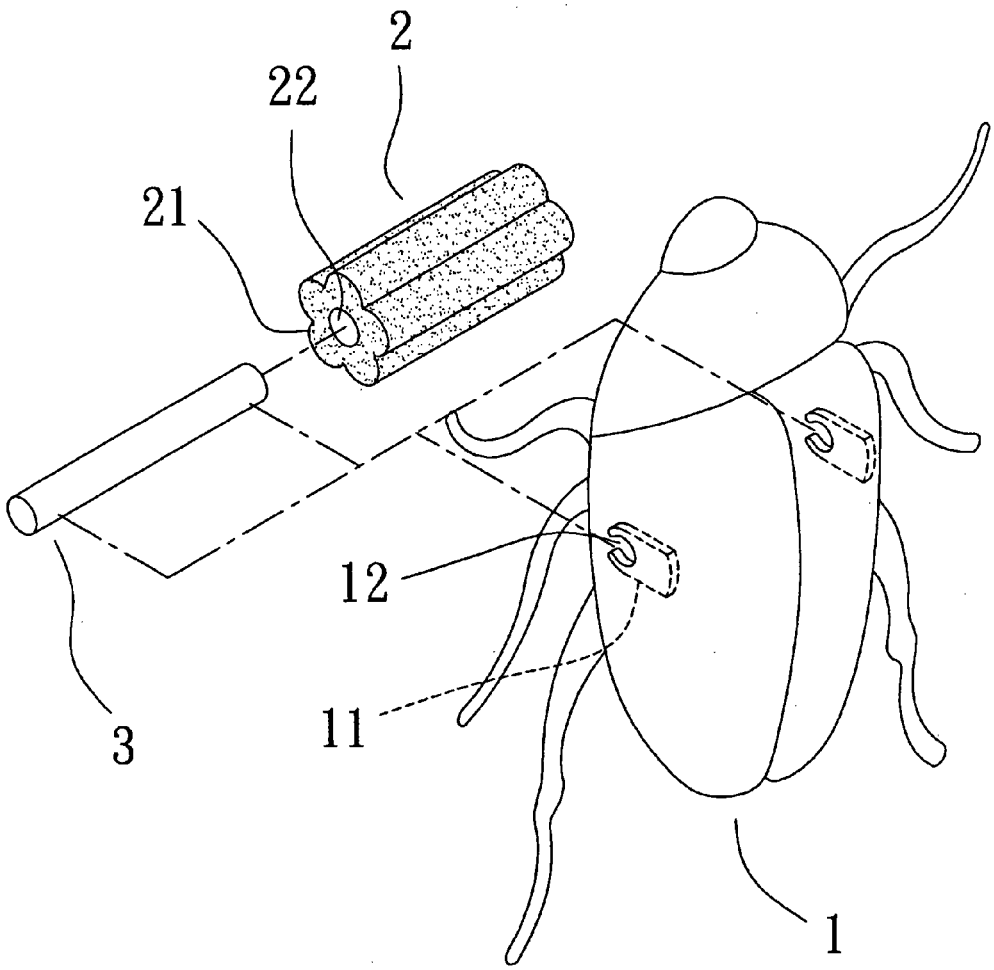
FIG. 1 is an exploded perspective view of a first embodiment of a toy in the present invention.

A first embodiment of a toy in the present invention, as shown in FIG. 1, includes a body 1, a roller 2, and a shaft 3 as main components combined together.

The body 1 may be shaped as any small animal, insect, such as a dog, a cat, a cockroach, a gecko, an automobile of any kind, etc. and made integral. The body 1 may also be 3D combining cards made of PP (polypropylene) or PS (polystyrene) or cardboard, having a lot of modes for children to play. Further, a pair of C-shaped plates 11 are fixed inside of the body 1, with each plate provided with a C-shape notch 12.

The roller 2 is made of a material having a proper viscosity, preferably a mixture made of such as TPR (thermal plastic rubber) and white oil, supplying the roller 2 with some viscosity to a smooth surface where the roller 2 may be placed on. One such white oil is Shell Ondina® Oil, made by the Shell Oil Corporation. Further, the roller 2 has a plurality of lengthwise convex protrusions 21 spaced apart equidistantly around its outer circumference, and a center shaft hole 22 for the shaft 3 to extend therein.

The shaft 3 extends and fixed firmly in the shaft hole 22 of the roller 2, having two ends to fit loosely in the C-shaped notches 12 of the two clamp plates 11, then the shaft 3 with the roller 2 rotates all together. But if the shaft 3 is fixed tightly with the two C-shaped notches 12, the roller 2 rotates with the shaft 3 functioning as a pivot.

Figure 4:
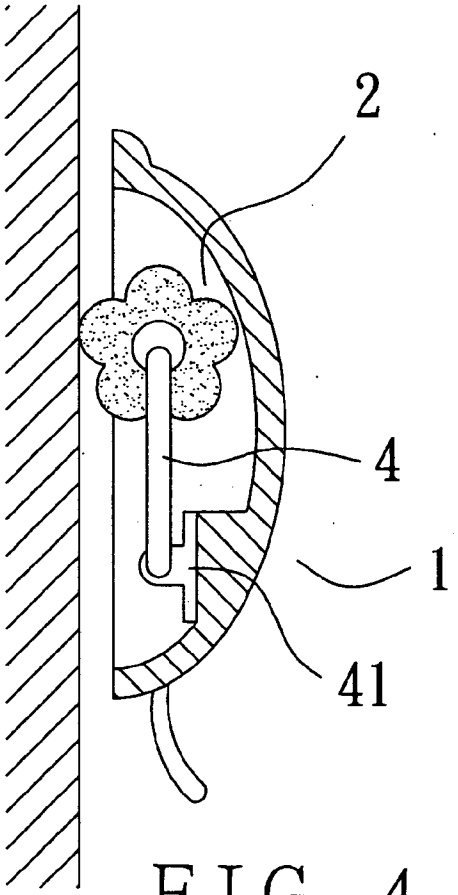
Figure 2:
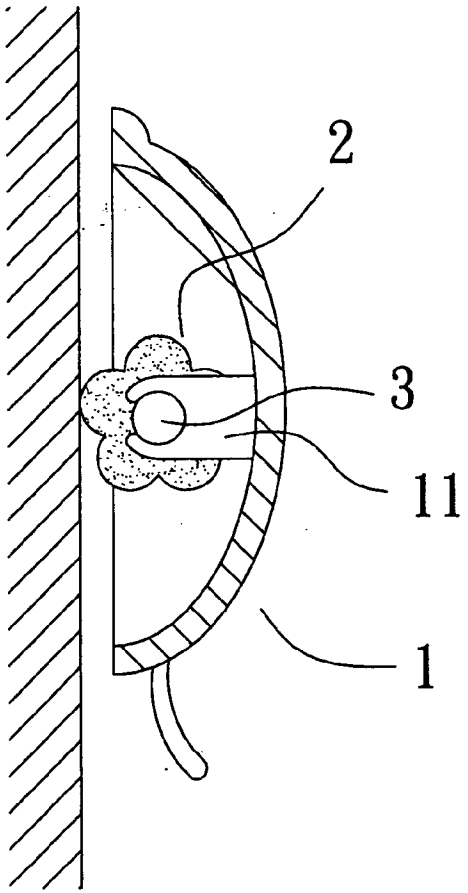
FIG. 2 is a side cross-sectional view of the first embodiment of a toy rolling down on a vertical wall in the present invention.
Figure 3:
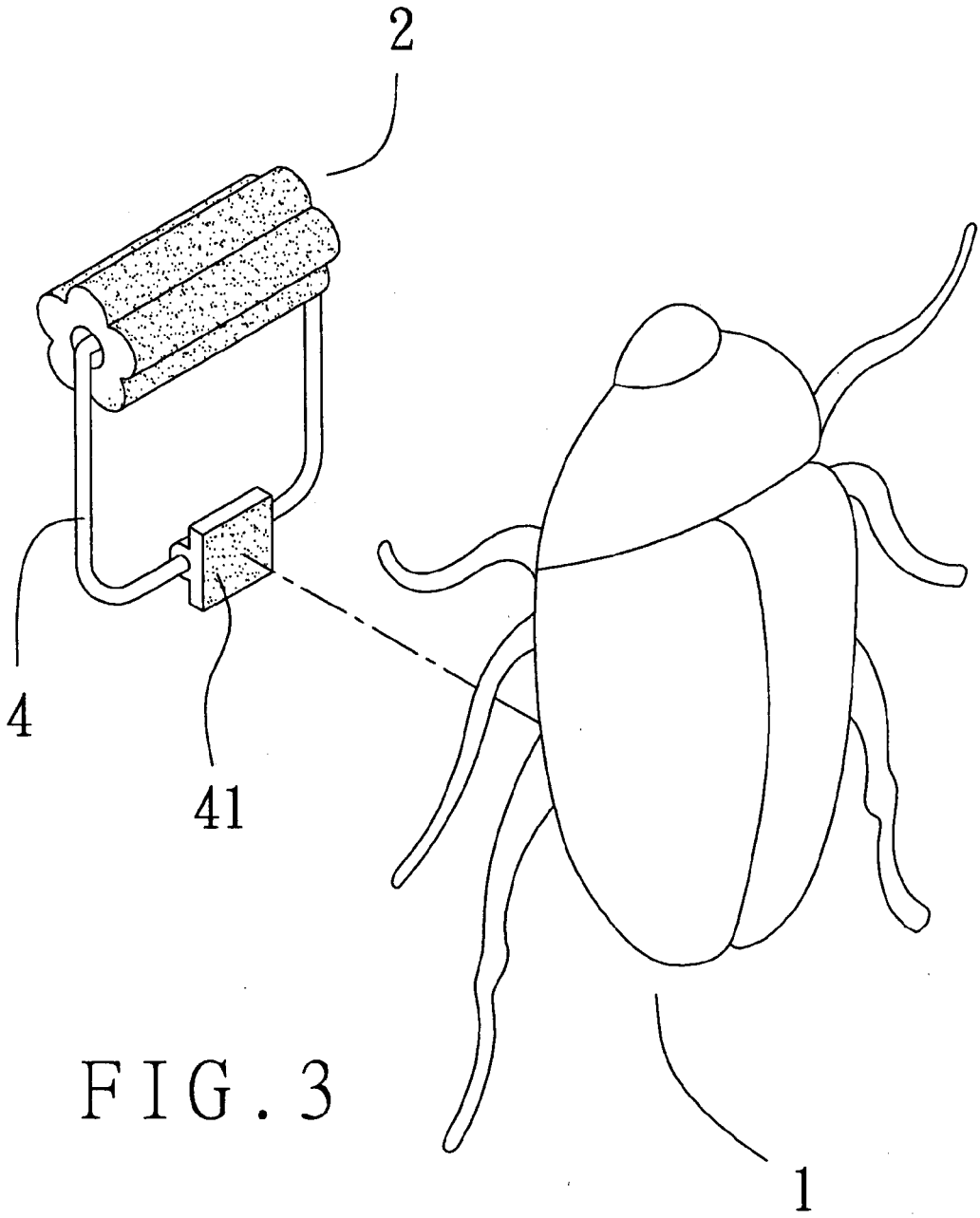
FIG. 3 is an exploded perspective view of a second embodiment of a toy in the present invention; and, FIG. 4 is cross-sectional view of the second embodiment of a toy rolling down on a vertical wall surface in the present invention.

In playing with the toy in the invention, as shown in FIG. 2, place the toy on a vertical wall, and let loose the hand holding the toy. Then the toy may slowly and gradually move down, with the roller 2 rolling down along the vertical wall surface without falling off because of the viscosity feature of the roller 2. As the roller 2 has some viscosity, it cannot quickly roll down, but adheres in some degrees the surface of the vertical wall to move down with slow motion, and at the same time driven by the weight of the toy itself, with the plurality of the convex protrusions 21 slowing down the speed of rolling action. Moreover, a second roller 2 or a third one 2 may be additionally fixed to a toy, depending on the size of the toy, In addition, FIGS. 3 and 4 show a second embodiment of a toy in the invention, which has the same structure as the first one, except that a U-shaped rod 4 is used instead of the shaft 3 in the first embodiment, with one bent end portion extending movably in the shaft hole 22 of the roller 2, with the other end fixed on a position plate 41 fixed on a flat portion of the body 1. Then the metal U-shaped rod 4 supports the roller 2 with some flexibility, increasing elastic movement of the toy.

The toy in the invention has the following advantages, if compared with common conventional toys.

1. The toy has the roller possessing a proper viscosity so that it can roll slowly down a steep slope or a vertical wall surface, which common conventional toys cannot do.

2. More than one roller in the invention can be employed in a toy, and the plural convex protrusions of the roller can permit the toy to slowly roll down a steep slope or even a vertical wall surface without falling off, in addition to the some adhesive property of the roller.

While the preferred embodiment of the invention have been described above, it will be recognized and understood that various modifications may be made therein and the appended claims are intended to cove all such modifications that may fall within the spirit and scope of the invention.

What is claimed is:

1. A toy comprising:

a body;

a position plate affixed to an inner wall of said body;

a U-shaped rod having a pair of opposing bent ends, a first of said bent ends being connected to said position plate; and, a roller formed of a material including thermal plastic rubber and white oil to provide a sticky surface, said roller having a centrally disposed shaft hole formed therethrough, a second of said bent ends passing through said shaft hole for rotation of said roller thereon, wherein said toy slowly rolls down an inclined or substantially vertical surface.

* * * * *